US008678957B1

(12) United States Patent
Essex

(10) Patent No.: US 8,678,957 B1
(45) Date of Patent: Mar. 25, 2014

(54) SPORTS TRAINING APPARATUS AND METHODS OF USE THEREOF

(75) Inventor: Scott P. Essex, Cornelius, NC (US)

(73) Assignee: Practice-Makes-Perfect, LLC, Cornelius, NC (US)

( * ) Notice: Subject to any disclaimer, the term of this patent is extended or adjusted under 35 U.S.C. 154(b) by 233 days.

(21) Appl. No.: 12/973,893

(22) Filed: Dec. 20, 2010

(51) Int. Cl.
*A63B 69/00* (2006.01)

(52) U.S. Cl.
USPC ..... 473/456; 273/402

(58) Field of Classification Search
USPC ..... 473/454–456, 476, 478; 273/398–402
See application file for complete search history.

(56) References Cited

U.S. PATENT DOCUMENTS

| | | | | | |
|---|---|---|---|---|---|
| 1,087,587 | A | | 2/1914 | Kennedy | |
| 2,059,365 | A | | 11/1936 | King | |
| 2,254,986 | A | * | 9/1941 | Ziel | 473/454 |
| 2,873,969 | A | | 2/1959 | Ziel | |
| 3,312,467 | A | * | 4/1967 | Dawson | 473/454 |
| 3,997,158 | A | * | 12/1976 | Britton | 473/454 |
| 4,118,028 | A | | 10/1978 | Larkin | |
| 4,254,952 | A | | 3/1981 | Playter, Jr. | |
| 4,344,621 | A | | 8/1982 | Baker | |
| 4,497,485 | A | * | 2/1985 | Macosko | 473/435 |
| 4,643,423 | A | * | 2/1987 | Wright | 473/456 |
| 5,083,774 | A | * | 1/1992 | Yalvac | 473/456 |
| 5,181,725 | A | | 1/1993 | Leras et al. | |
| 5,217,230 | A | * | 6/1993 | Judd | 473/416 |
| 5,333,856 | A | * | 8/1994 | Gery | 473/454 |
| D354,992 | S | | 1/1995 | Hinsperger | |
| 5,433,434 | A | * | 7/1995 | Helmetsie | 473/446 |
| 5,439,211 | A | * | 8/1995 | Drabowsky | 473/456 |
| 5,511,775 | A | * | 4/1996 | Parks | 473/454 |
| 5,516,115 | A | * | 5/1996 | McLain | 473/417 |
| 5,524,901 | A | | 6/1996 | Bison et al. | |
| 5,527,032 | A | * | 6/1996 | Coleman et al. | 473/439 |
| 5,599,017 | A | * | 2/1997 | Bixler et al. | 473/436 |
| D380,797 | S | | 7/1997 | Schwan et al. | |
| D401,308 | S | | 11/1998 | D'Emidio | |
| 5,934,679 | A | | 8/1999 | Strain et al. | |
| 6,155,936 | A | * | 12/2000 | Dorr | 473/456 |
| 6,200,235 | B1 | | 3/2001 | Gembarowicz | |
| 6,659,466 | B2 | * | 12/2003 | Searles et al. | 273/400 |
| 7,021,630 | B1 | * | 4/2006 | Cho | 273/401 |

(Continued)

OTHER PUBLICATIONS

Web-page http://baseballtips.com/zone-in-target.html; showing product sold under the mark Zone In Pitching Target; web-page dated Apr. 22, 2010.

(Continued)

*Primary Examiner* — Mark Graham
(74) *Attorney, Agent, or Firm* — Everman Law Firm, PA; Gregory R. Everman

(57) ABSTRACT

An apparatus for use in practicing pitching and aiming a baseball which includes a target screen having a first attachment apparatus for attaching the target screen to a structure, a first aperture, and a frame attached to the target screen and being positioned at a perimeter of the first aperture thereby reinforcing the target screen around the perimeter of the first aperture against impacts from thrown baseballs. The frame has a rigid construction and defines an opening generally having the shape and size of a baseball strike zone. A plurality of elastic members subdivide the opening, and thus the strike zone, into nine sections to aid a player in aiming for different locations within the strike zone. The opening and first aperture communicate such that thrown baseballs which pass through the first aperture also pass through the opening.

18 Claims, 11 Drawing Sheets

(56) References Cited

U.S. PATENT DOCUMENTS

| | | | | |
|---|---|---|---|---|
| D540,406 | S | 4/2007 | Edmondson, Jr. | |
| 7,293,776 | B2 | 11/2007 | Fenwick | |
| 7,704,169 | B1 * | 4/2010 | Bove et al. | 473/426 |
| 2002/0049103 | A1 * | 4/2002 | Treihart | 473/454 |
| 2002/0151387 | A1 | 10/2002 | Henson | |
| 2003/0228943 | A1 * | 12/2003 | Powell | 473/454 |
| 2004/0014538 | A1 * | 1/2004 | Bennett | 473/456 |
| 2004/0127308 | A1 * | 7/2004 | Swanson | 473/454 |
| 2005/0137035 | A1 * | 6/2005 | Huang et al. | 473/454 |
| 2007/0072705 | A1 | 3/2007 | Ono | |
| 2007/0281807 | A1 | 12/2007 | Cho | |
| 2008/0312011 | A1 * | 12/2008 | Edmondson | 473/456 |
| 2010/0075783 | A1 * | 3/2010 | Edmondson | 473/421 |
| 2010/0081513 | A1 | 4/2010 | La Pointe | |
| 2012/0010028 | A1 * | 1/2012 | Hammons | 473/454 |

OTHER PUBLICATIONS

Web-page http://baseballtips.com/zone-in-target.html; product Zone In Pitching Target.

* cited by examiner

SPORTS TRAINING APPARATUS AND METHODS OF USE THEREOF

BACKGROUND OF THE INVENTION

1. Field of the Invention

The present invention relates to a sports training apparatus and, more specifically, to a target screen having a strike zone which is attachable to a structure such as, for example, a swing set for use in practicing pitching and aiming a baseball.

2. Description of the Prior Art

Conventionally, to practice pitching the pitcher would have to engage the services of a human catcher. Similarly, to practice throwing to first base, a cut-off throw or a throw for when a person is stealing second base, the ballplayer would need to find another player. However, a second player is not always readily available. Moreover, the other player needs to be sufficiently proficient in catching, otherwise much time may be wasted chasing after missed balls and it may be difficult to determined whether a pitched ball was delivered accurately into the strike zone.

Numerous conventional devices have been developed to aid a player in practicing pitching and to address the aforementioned issues. Such devices include screens with openings through which a player attempts to throw a ball. Examples of such devices include U.S. Pat. No. 2,873,969, to M. G. Ziel; U.S. Pat. No. 4,118,028, to Larkin; U.S. Pat. No. 4,254,952, to Playter, Jr.; U.S. Pat. No. 4,275,883, to Grimaldi et al.; and U.S. Pat. No. 5,527,032, to Coleman et al.

Nevertheless, conventional devices are limited by being susceptible to damage from repeated ball strikes around the perimeter of the strike zone, are limited in signaling where in the strike zone that the ball was thrown and/or require a dedicated structure for deploying the device rather than being adapted for use with a typical backyard item such as a swing set. Conventional pitching targets that require a dedicated structure are problematic for families having modest yards without suitable useful space for both a pitching aid and a swing set causing them to decide which one of the two to set-up. This can be a divisive issue as children differ in their interest, particularly where there are children of different ages.

Although there are numerous devices in the art to aid a player in practicing pitching and aiming a baseball, there remains a need for a simply constructed pitching target that is durable against repeated impacts that occur at and near aimed for locations on the target. There is also need in the art for a pitching target that clearly indicates which part of the strike zone through which the ball was thrown. Further, there is a need in the art for a pitching target that is easily attachable to an existing structure such as a swing set so that a common area can be interchangeably be used for both swinging and practicing pitching.

BRIEF SUMMARY OF THE INVENTION

The present invention relates to a sports training apparatus having a target screen with a strike zone and being attachable to a structure such as, for example, a swing set for use in practicing pitching and aiming a baseball. In specific embodiments, the sports training apparatus is simply constructed having a target screen that is durable against repeated impacts from baseballs which occur at and near the strike zone, clearly indicates which part of the strike zone through which the ball was thrown, and/or is easily attachable to an existing structure such as a swing set so that a common area can be interchangeably be used for both swinging and practicing pitching.

The present invention is an apparatus for use in practicing pitching and aiming a baseball and includes a target screen having a first attachment apparatus for attaching the target screen to a structure, a first aperture, and a frame attached to the target screen and being positioned at a perimeter of the first aperture thereby reinforcing the target screen around the perimeter of the first aperture against impacts of thrown baseballs. The frame has a rigid construction and defines an opening generally having the shape and size of a baseball strike zone. The opening and first aperture communicate such that thrown baseballs which pass through the first aperture also pass through the opening.

In an embodiment the opening defined by the frame is generally rectangular having a height in a range of about 20-26 inches and a width in a range of about 16 to 22 inches. Additionally, one or more elastic member are attached to the frame in such a manner that the elastic member(s) divides the opening into two or more sections. The elastic member is characterized by being able to stretch when struck by the baseball and resiliently return to its original shape after removal of force from the baseball. Preferably, at least one mechanical fastener releaseably attaches the one or more elastic member to the frame and the frame to the target screen such that the one or more elastic member and the frame can be removed from the target screen and replaced without damage to the target screen.

In an embodiment, two elastic members are attached to the frame and disposed generally horizontally across the opening and two elastic members are attached to the frame and disposed generally vertically across the opening when the target screen is in a deployed position. The horizontally and vertically disposed elastic members divide the opening into nine sections. The horizontally and vertically disposed elastic members are characterized by being able to stretch when struck by the baseball and resiliently return to their original shape after removal of force from the baseball. Preferably, the elastic members divide the opening into nine generally rectangular sections arranged in a pattern of three rows and three columns in which each section has a height in a range of about 6⅔ inches to 8⅔ inches and a width in a range of about 5½ inches to 7⅓ inches. The horizontally and vertically disposed elastic members are attached to each other at the locations where they cross over each other. Optionally, flaps are attached to the elastic members, such that a flap hangs in each section to provide a visual confirmation of strike location of a ball thrown through the opening.

In an embodiment, the first attachment apparatus is provided at or near the top of the target screen and is capable of holding the target screen in the deployed position when the apparatus is properly attached to a structure. As used herein when describing positioning of an element, the term "at" is inclusive of the term "near". The first attachment apparatus includes top elastic members for attaching the target screen to the structure; the top elastic members can elastically deform upon application of a force upon the target screen and resiliently return their original shape upon removal of the force. A second attachment apparatus is provided at or near the bottom of the target screen and assists the first attachment apparatus in holding the target screen in the deployed position. Preferably, the second attachment apparatus includes an anchoring member having a mass of 3 pounds or more and is positioned near or at the bottom of the target screen.

In an embodiment, the target screen further includes a plurality of apertures positioned in an array pattern across the target screen and each being of sufficient size through which a baseball may pass. The plurality of apertures includes a second aperture positioned above and leftward or rightward of the strike zone, a third aperture positioned above the strike zone and at a height less than that of the second aperture, and a fourth aperture positioned at a height lower than the second and third apertures and on an opposed side of the strike zone as is the second aperture, when the target screen is in the deployed position. Graphics may be provided on the target screen, depicting at least one athlete in an action pose, numbers which represent point values for the different sections of the opening and the second, third and fourth apertures.

In an embodiment, an apparatus for use in practicing pitching and aiming a baseball is provided. The apparatus includes a target screen having a first aperture, a means for attaching a top of the target screen to a structure and capable of holding the target screen in a deployed position, a means for attaching a bottom of the target screen to the structure, and a frame of a rigid construction attached to the target screen wherein the frame is positioned at a perimeter of the first aperture and reinforces the target screen around the perimeter of the first aperture such that structural integrity of the target screen at the perimeter of the first aperture is enhanced against impacts from thrown baseballs. The frame defines an opening generally having the shape and size of a baseball strike zone. The first aperture and opening communicate whereby thrown baseballs which pass through the first aperture also pass through the opening. The means for attaching a top of the target screen includes elastic members which can elastically deform upon application of a force applied to the target screen and resiliently return their original shape upon removal of the force. The means for attaching a bottom of the target screen includes an anchoring member having a mass of 3 pounds or more.

BRIEF DESCRIPTION OF THE DRAWING

The above described and other features, aspects, and advantages of the present invention are better understood when the following detailed description of the invention is read with reference to the accompanying drawings, wherein.

DETAILED DESCRIPTION OF THE INVENTION

The present invention will now be described more fully hereinafter with reference to the accompanying drawings in which preferred embodiments of the invention are shown. This invention may, however, be embodied in many different forms and should not be construed as limited to the embodiments set forth herein. These exemplary embodiments are provided so that this disclosure will be both thorough and complete, and will fully convey the scope of the invention to those skilled in the art.

Figure 1:
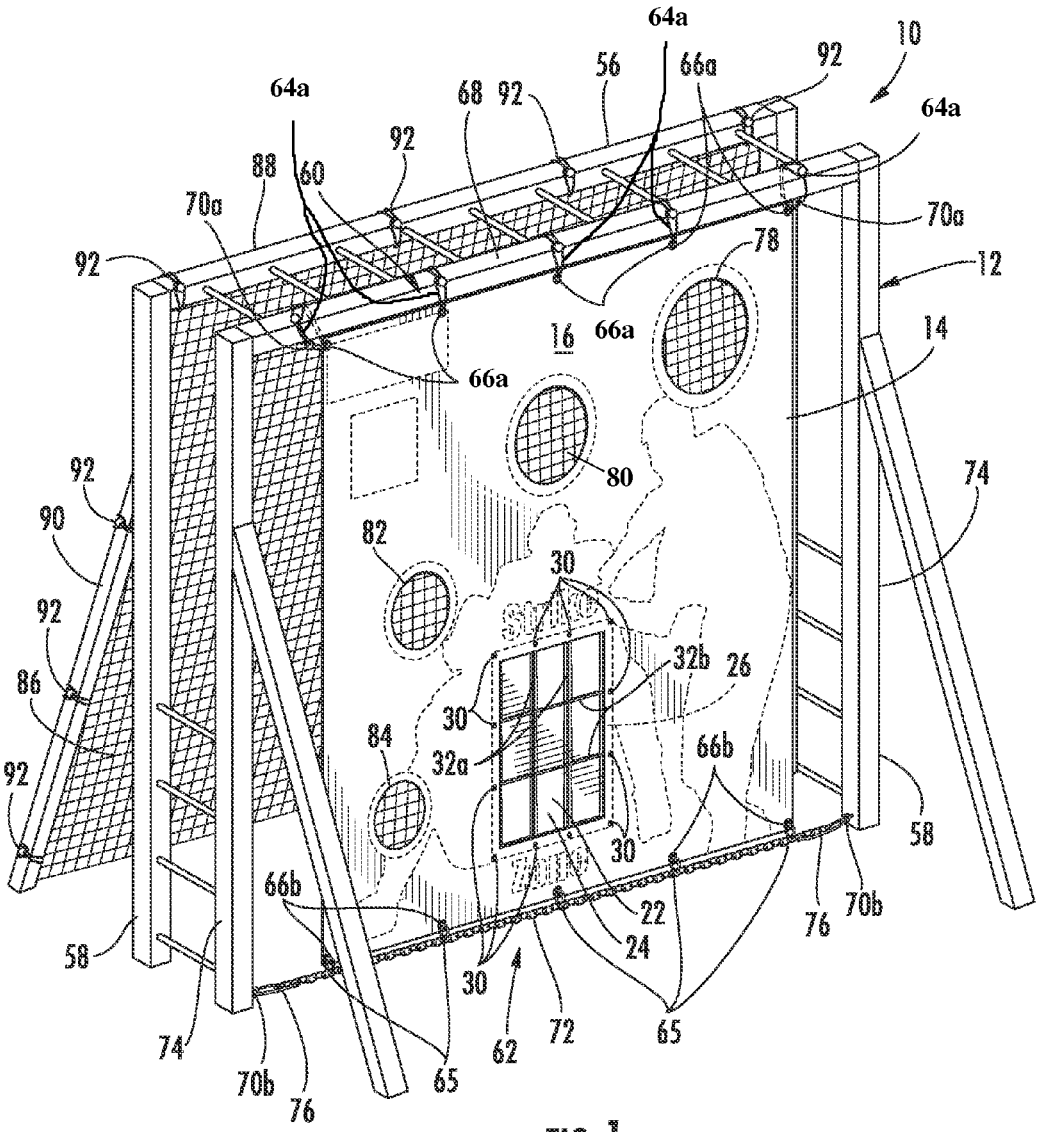
FIG. 1 is a top, front, left side perspective view of a sports training apparatus having a strike zone for practicing pitching and aiming a baseball, attached for use to a swing set having monkey bars, in accordance with an embodiment of the present invention.
Figure 2:
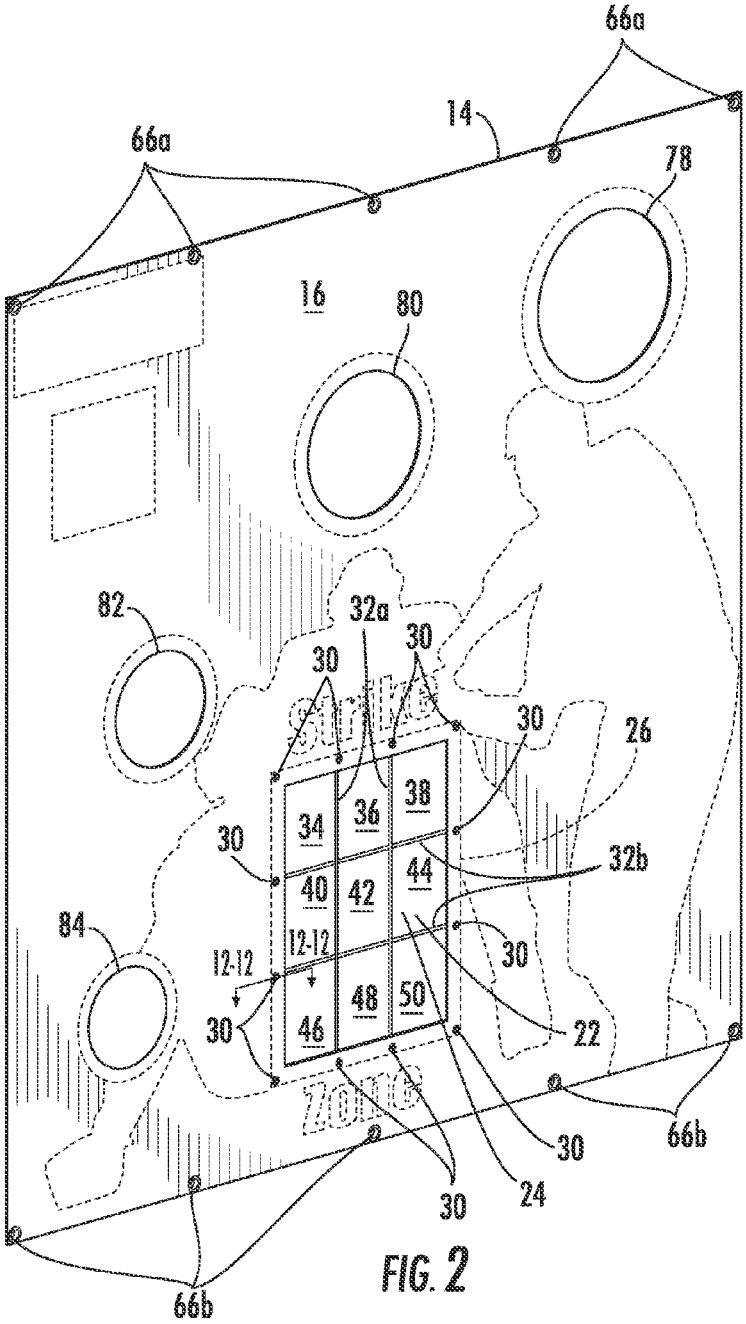
FIG. 2 is a top, front, left side perspective view of the sports training apparatus of FIG. 1.
Figure 3:
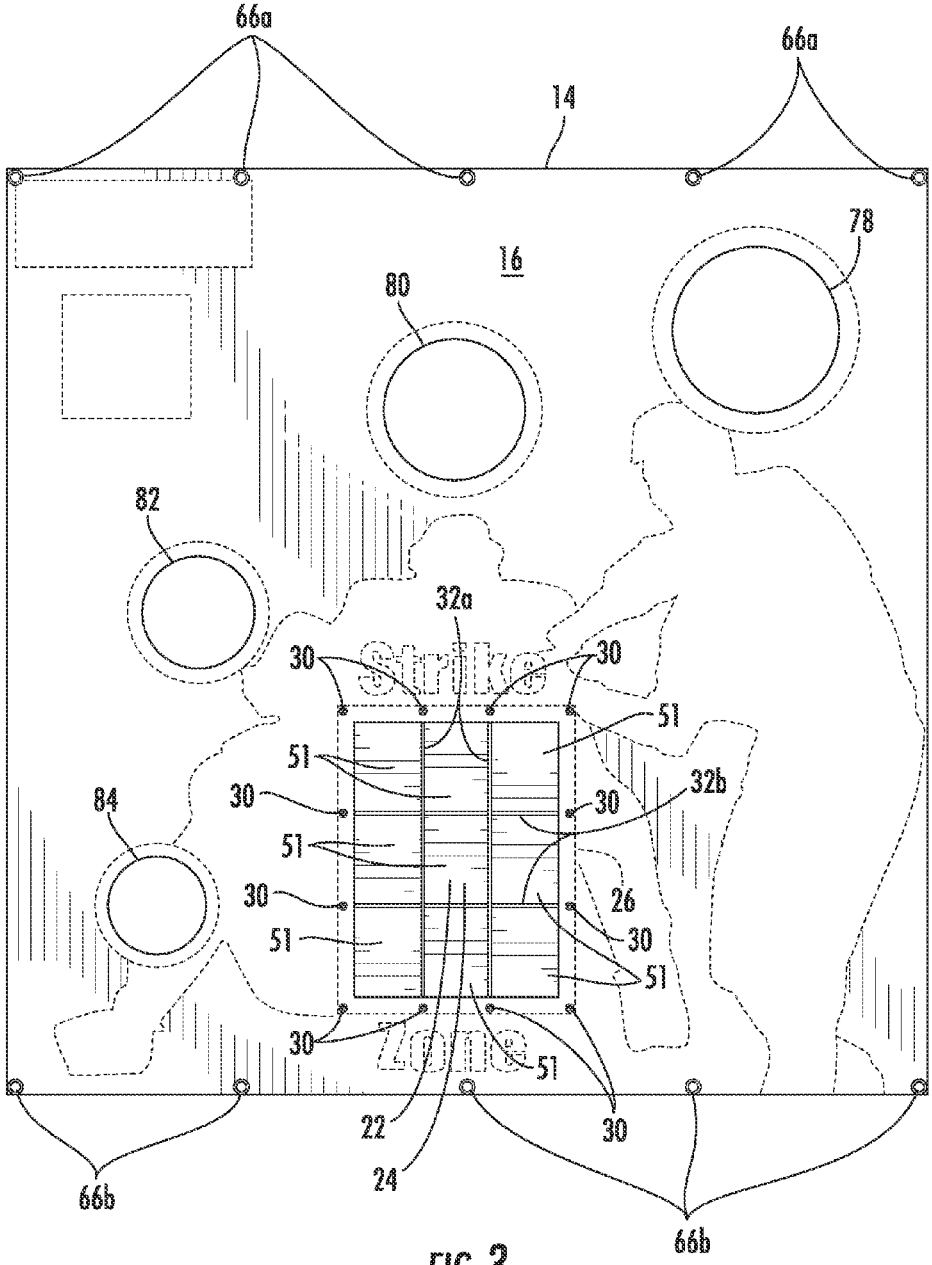
FIG. 3 is a front elevational view of the sports training apparatus of FIG. 2.
Figure 4:
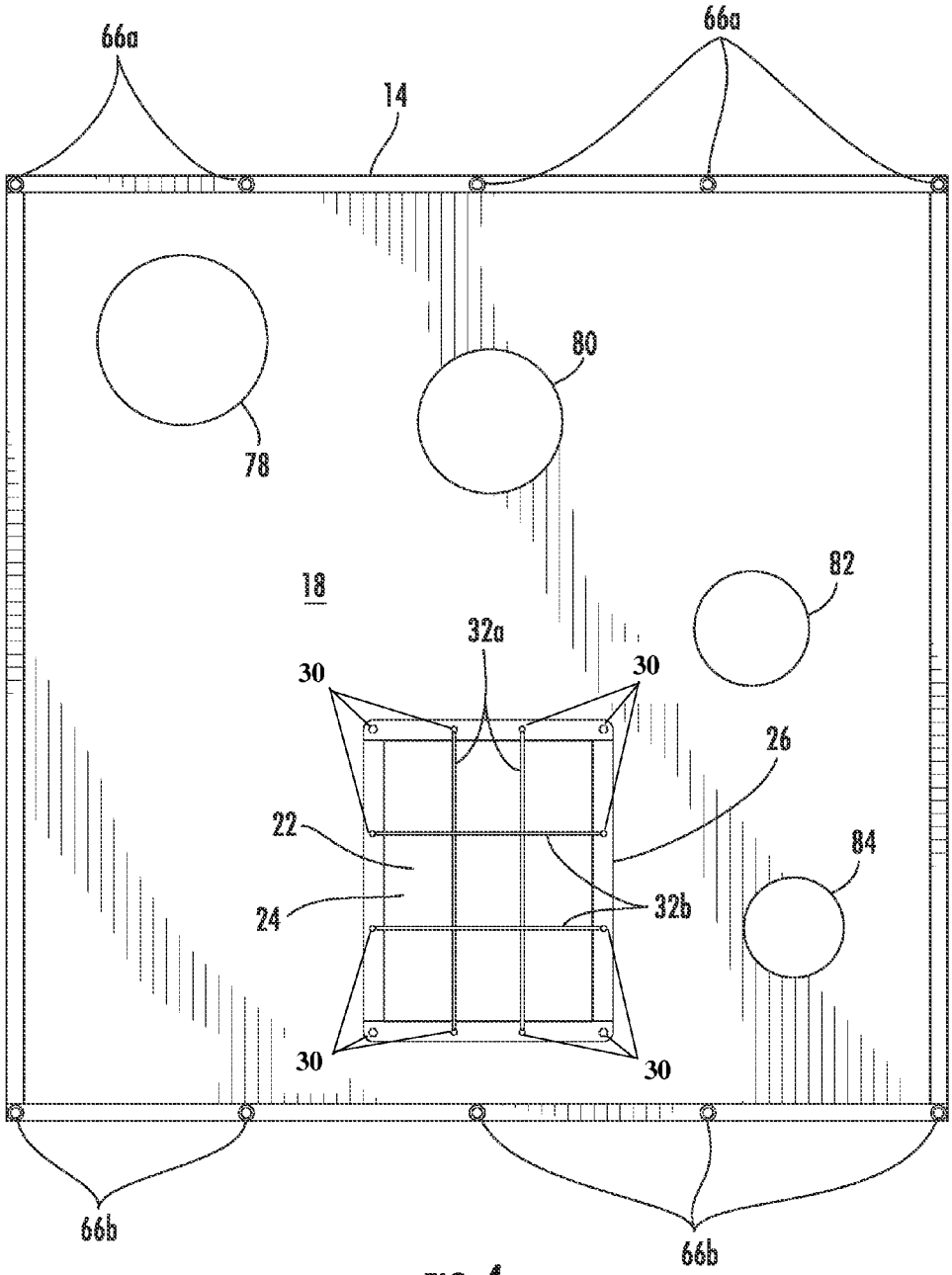
FIG. 4 is a rear elevational view of the sports training apparatus of FIG. 2.
Figure 5:
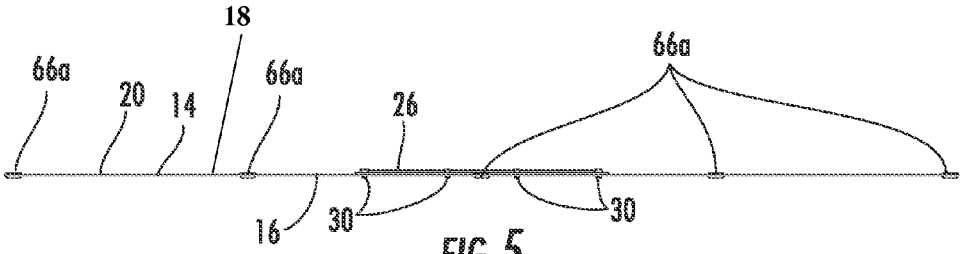
FIG. 5 is a top plan view of the sports training apparatus of FIG. 2.
Figure 6:
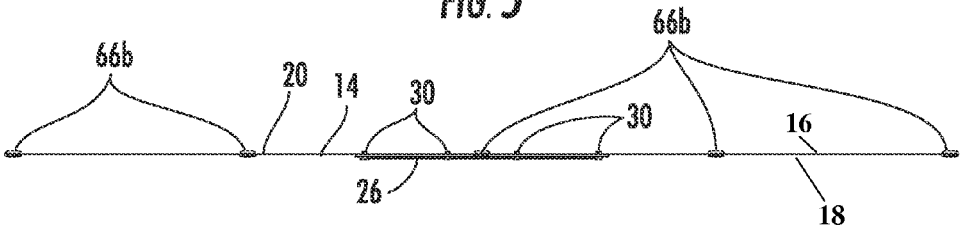
FIG. 6 is a bottom plan view of the sports training apparatus of FIG. 2.
Figure 7:
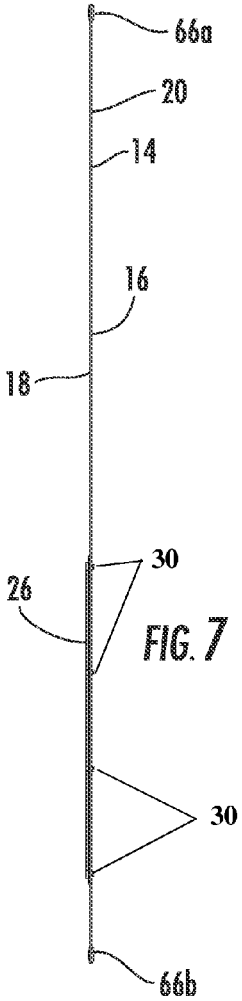
FIG. 7 is a left side elevational view of the sports training apparatus of FIG. 2.
Figure 8:
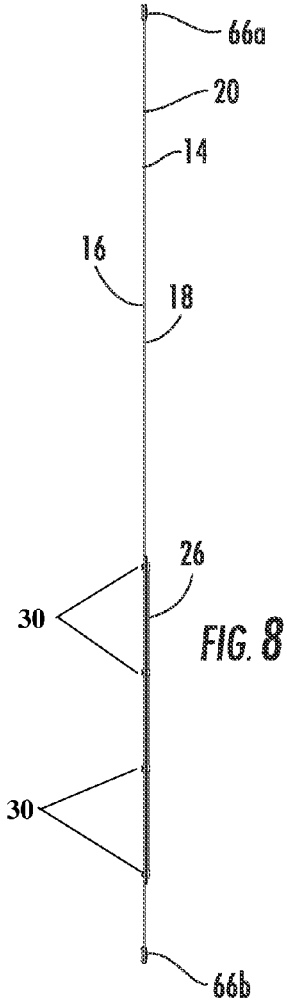
FIG. 8 is a right side elevational view of the sports training apparatus of FIG. 2.

Referring the drawings, and particularly to FIG. 1, a sports training apparatus 10, 10*a* (FIG. 15), 10*b* (FIG. 16) having a strike zone 24 for practicing pitching and aiming a baseball is illustrated attached for use to a structure such as, for example, a swing set 12 with monkey bars 56, an A-frame swing set 12*a* (FIG. 15), an installation frame 12*b* (FIG. 16), or the like, which holds the apparatus 10, 10*a* (FIG. 15), 10*b* (FIG. 16) in a deployed state for use. The sports training apparatus 10, 10*a* (FIG. 15), 10*b* (FIG. 16) is of a durable construction to withstand repeated impacts of thrown baseballs striking at or near the strike zone 24. And, by being easily attachable to a swing set 12, 12*a* (FIG. 15), it will be appreciated by those with modest yards that a common area can be interchangeably be used for both swinging and practicing pitching.

Referring to FIGS. 1-8 collectively, the sports training apparatus 10 is illustrated in accordance with an embodiment of the present invention. The sports training apparatus 10 includes a target screen 14 that is generally flat, having large, planar, major front and rear surfaces 16, 18 and a relatively thin width 20. The target screen 14 is sized to fit for attachment within the framework of conventional swing sets, such as illustrated swing set 12 having monkey bars 56 and A-Frame swing set 12*a* (FIG. 15), provides sufficient area to present targeted openings at which a player may throw baseballs and softballs (collectively "baseballs"), and act as a barrier to block errant throws. Graphic images of players in action poses, points/numbers identifying a value to specific targets, and other graphics are provided on the front major surface to enhance the overall experience of playing and training with the apparatus 10. Not to be construed as limiting, an example of a suitably sized target screen measures in the range of 6 to 8 feet in height, 6 to 12 feet in width, and 1/16 to 1/3 inch in width. It is to be understood that the target screen 14 may be constructed in other dimensions as desired in order to accommodate swing sets of various dimensions or other structures to which the target screen 14 may be attached, or to provide additional area to add further targets at which to aim a baseball.

The target screen 14 is of a flexible construction so that it can be easily rolled up or folded for storage and is freely displaced at the point of impact when struck by a baseball. The target screen 14 is made of a material that is suitable for outdoor use and exposure to the elements and temperatures of all four season. Not to be construed as limiting, a preferred material is plastic, particularly vinyl. Less preferred materials include fabric.

The target screen 14 has a first aperture 22 that corresponds to the strike zone 24. A frame 26 is attached to the target screen 14 and defines an opening 24 which forms the strike zone 24 and which is substantially coextensive with the target screen first aperture 22 such that a thrown baseball which passes through the opening 24 also passes through the first aperture 22. (Reference number 24 is used interchangeably for the opening 24 and strike zone 24 since they are the same opening). The opening 24 and thus strike zone 24 have a generally rectangular shape and size that is associated with the game of baseball, i.e. having a height in a range of about 22-26 inches, more preferably about 24 inches, and a width in a range of about 16 to 20 inches, more preferably 18 inches. In an embodiment, the center of the opening 24 is centered between the left and right edges of the target screen 14 and about 20 inches from the bottom edge of the target screen 14.

The frame 26 is substantially rigid in order to hold its shape with little to no deflection during normal use of the sports trailing apparatus 10. As used herein, the term rigid includes properties in which the frame 20 bends slightly under forces which may occur during normal use such as when struck by a thrown baseball, and resiliently returns to its original shape upon removal of such forces. A preferred material is plastic, however other less preferred materials such as wood and metal may also be used.

Figure 12:
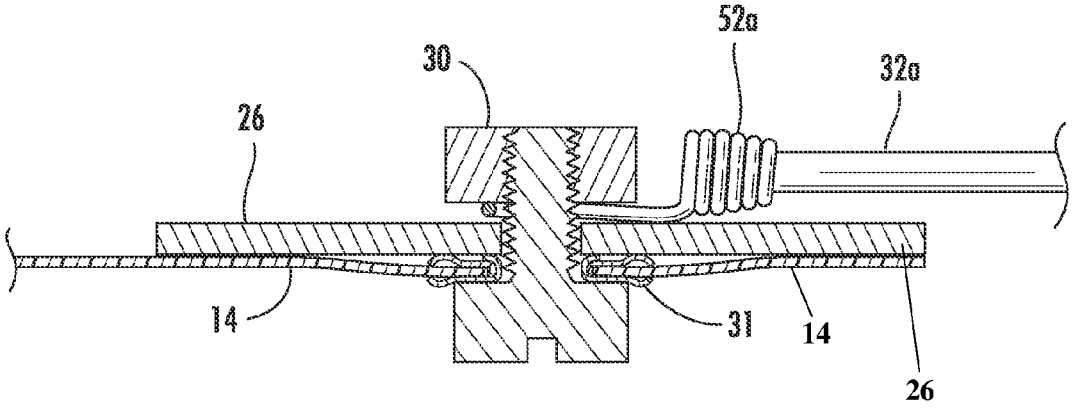
FIG. 12 is a fragmented, cross-sectional, side elevational front view of the strike zone taken along section line 12-12 of FIG. 2.
Figure 13:
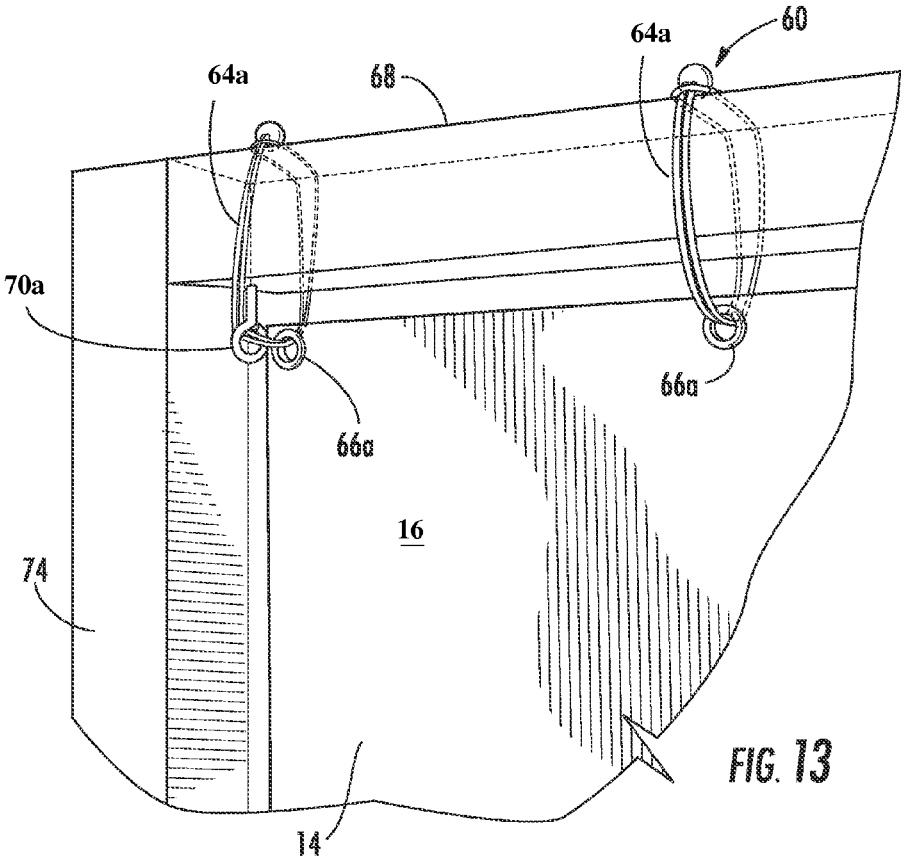
FIG. 13 is a detail taken from FIG. 1, illustrating the method of attachment of the top left corner of the sports training apparatus to the swing set.

Referring to FIGS. 1-8 and 12, the frame 26 is attached to the target screen 14 by any suitable means, for example by mechanical fasteners 30, adhesive, and/or stitching. In the preferred embodiment, the frame 26 and target screen 14 are joined together by mechanical fasteners 30, e.g. nuts and bolts of a nylon construction, which allow for the frame 26 to be removed and replaced in the event that a need arises to do so without causing damage to the target screen 14. Referring to FIG. 12, coaxial openings are provided in target screen 14 and frame 26, through which the mechanical fasteners 30 are received thereby securing the frame 26 (and elastic members 32*a*, 32*b*) to the target screen 14. Grommets 31 are provided in the target screen 14 to improve durability of the target screen 14 where the mechanical fasteners 30 are received through the target screen 14.

The frame 26 provides a highly durable, impact resistant framework around the strike zone 24, particularly as compared to the durability of the target screen 14. That is, without the frame 26 providing support, the structural integrity of the target screen 14 would be weaker around the first aperture 22 as a result of the first aperture 22. Yet, the region around to the first aperture 22 is likely to be impacted by a disproportionate number of thrown baseballs, leading to damage and tearing in the target screen 14 around the first aperture 22. As a rip in the target screen 14 becomes larger, thrown balls that ordinarily would be a little outside of the strike zone 24 and blocked could find there way through the enlarged opening giving the false appearance of a strike being thrown. Over time, such a rip could expand to a point that renders the target screen 14 useless. Advantageously, the frame 26 mitigates this potential problem by reinforcing the target screen 14 around the strike zone 24.

The frame 26 also has utility in providing a more defined strike zone 24. By being rigid with little to no deflection, thrown baseballs that principally impact the frame 26 do not deform the frame 26 and thus remain blocked from entering the strike zone 24. In contrast, should there not be a frame 26, baseballs engaging the target screen 14 around the perimeter of the strike zone 24 may more easily deflect the target screen 14 and inadvertently work their way into the strike zone 24.

Referring to FIGS. 1-4, 10 and 12, the frame 26 serves to anchor a plurality of elastic members 32*a*, 32*b* which crisscross through the opening 24, i.e. the strike zone 24, subdividing it into different sections. In the preferred embodiment, the elastic members 32*a*, 32*b* divide the strike zone 24 into nine different sections: upper-outside corner 34, upper center 36, upper-inside corner 38, middle-outside 40, center 42, middle-inside 44, lower-outside corner 46, lower center 48, and lower-inside corner 50. The nine sections are in a pattern of three rows and three columns, each section being rectangular and of the same size, and having a height in a range of about 6⅔ inches to 8⅔ inches in height, more preferably about 8 inches, and a width in a range of about 5½ inches to 7⅓ inches, more preferably about 6 inches. Flaps 51 may be provided, hanging into the sections 34, 36, 38, 40, 42, 44, 46, 48, 50 from the elastic member 32*a*, 32*b* in order to provide a visual confirmation of strike location of a ball thrown through the opening 24.

Figure 9:
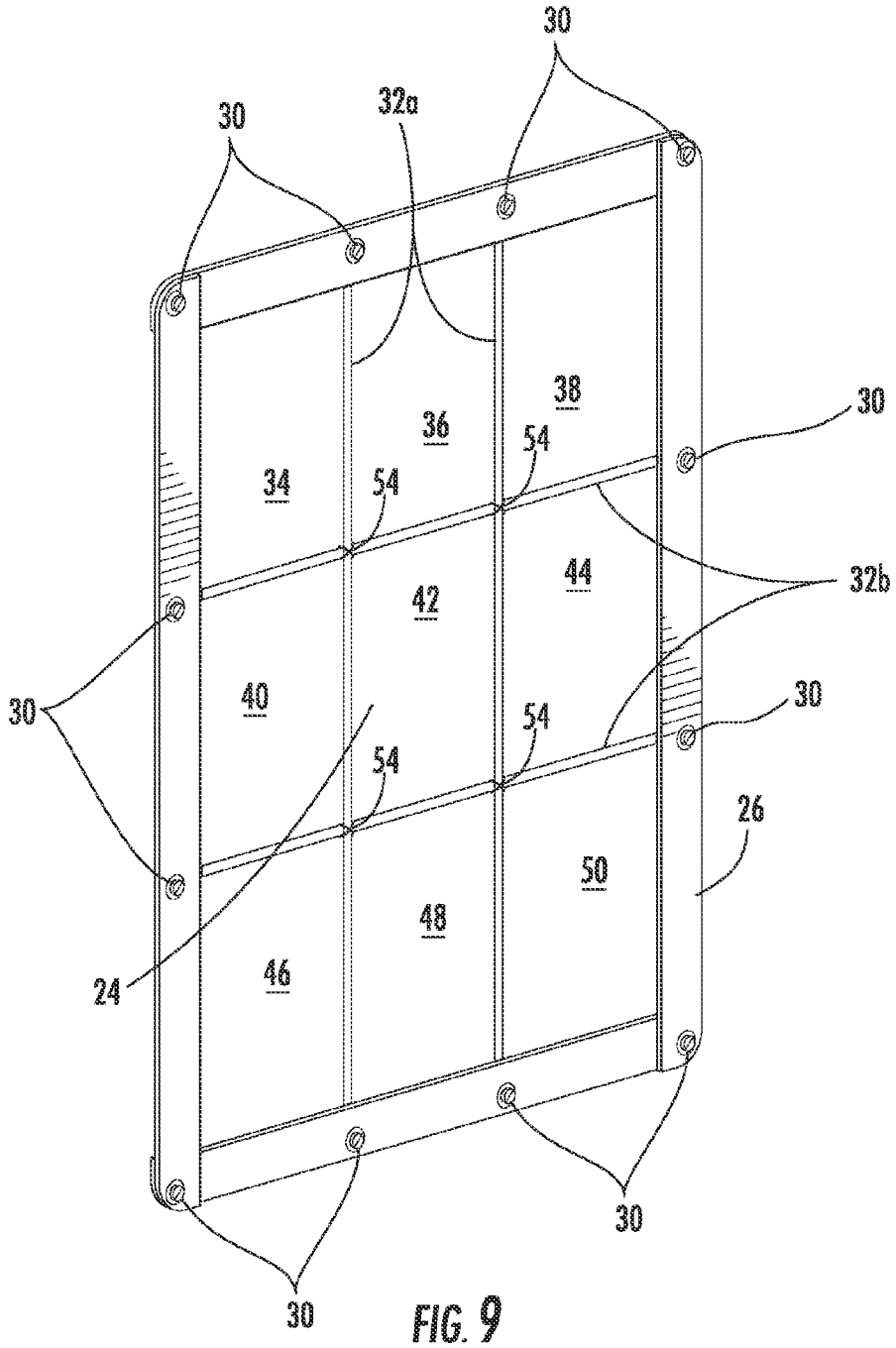
FIG. 9 is a top, front, left side perspective view of a frame which defines the strike zone and forms part of the sports training apparatus of FIG. 2.
Figure 10:
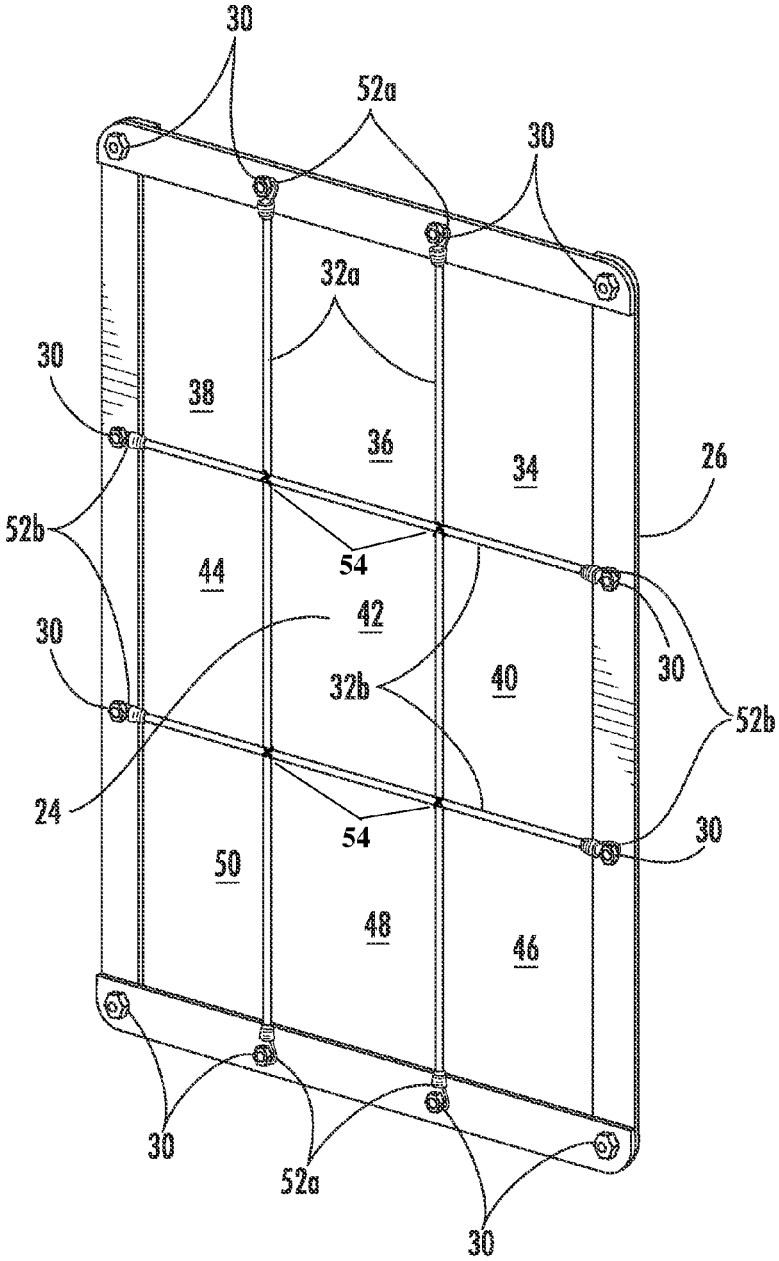
FIG. 10 is a top, rear, left side perspective view of the frame of FIG. 9.
Figure 11:
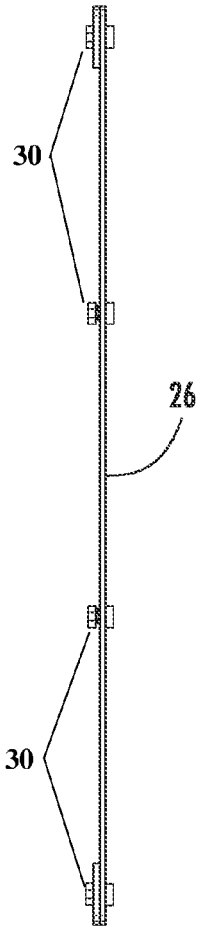
FIG. 11 is a left side elevational view of the frame of FIG. 9.

Referring to FIGS. 9 and 10, four elastic members 32*a*, 32*b* are provided to create the nine regions of the strike zone 24; two (i.e. 32*a*) being generally vertically disposed and the other two (i.e. 32*b*) being generally horizontally disposed. Each of the elastic members 32*a*, 32*b* are attached to the frame 26 by any suitable means, for example and without limitation by mechanical fasteners 30 such as a vinyl nuts and bolts as shown, tying, adhesive, or the like. In the illustrated embodiment, the elastic members 32*a*, 32*b* are bungee cords having hooked ends 52*a*, 52*b* (see FIG. 12). The hooked ends 52*a*, 52*b* are attached to the mechanical fasteners 30 which secure the elastic members 32*a*, 32*b* to the frame 26 (see FIG. 12). The mechanical fasteners 30 allow for the elastic members 32*a*, 32*b* to be released from the sports training apparatus 10 for replacement as desired.

Although four elastic members 32*a*, 32*b* are illustrated, it is to be understood that fewer elastic members may be used to subdivide the opening 24 into nine sections. For example, a single elastic member can be used to cross the opening 24 more than once to form both the top and bottom horizontally disposed elastic members 32*b*, both the left and right vertically disposed members 32*a*, and/or all the elastic members 32*a*, 32*b*. Where such is the case, each crossing is considered herein to be an elastic member. Thus, where one elastic member forms both the top and bottom horizontally disposed elastic members 32*b*, this is considered to be two elastic members for purposes of this application.

By the frame 26 being substantially rigid, the elastic members 32*a*, 32*b* are held taunt in the desired crisscross pattern. Preferably, the vertical and horizontal elastic members 32*a*, 32*b* are joined together at their intersection points by any suitable manner, for example by clips 54 as shown in FIGS. 9 and 10), tying, adhesive or the like.

Thus, when a baseball impacts upon one or more elastic members 32*a*, 32*b*, the members 32*a*, 32*b* stretch and deform to move aside and allow the baseball to continue into the strike zone 24. As the members 32*a*, 32*b* are joined at their intersection points, the baseball will pass through the strike zone 24 being maintained in the section that it principally started in so that the player will be able to determine where the pitch was located.

The resilient characteristic of the elastic members 32*a*, 32*b* causes the members 32*a*, 32*b* to return to their original position and shape after impact and thus be ready for the next pitched ball. Also, by being elastic, the magnitude of forces transmitted to the frame 26 are reduced and in any case, the rigid nature of the frame 26 causes it to maintain its integrity during baseball to elastic member(s) 32*a*, 32*b* impacts. And, the grommets 31 (FIG. 12) assist in protecting target screen 14 from premature failure by providing a protective barrier between the mechanical fasteners 30 and screen 14.

Again, it is of importance that the frame 26 protects the target screen 14 from premature damage. That is, without the frame, the elastic members 32*a*, 32*b* would be anchored to the target screen 14 which would then have a higher likelihood of early tearing due to point loading where the members 32*a*, 32*b* attach to the screen 14.

Referring to FIG. 1 the sports training apparatus 10 is illustrated attached to a swing set 12 having monkey bars 56 and side ladders 58 by a top attachment apparatus 60 and a bottom attachment apparatus 62. The top and bottom attachment apparatuses 60, 62 serve to secure the sports training apparatus 10 to the structure 12, 12*a* (FIG. 15), 12*b* (FIG. 16) in order to hold the target screen 14 in deployed position in which at least a portion and preferably the entirety of the target screen 14 is suspended above the ground and the front major surface 16 is fully open and viewable. More preferred, the deployed position further includes the target screen 14 being vertically oriented and limited in its amount of movement. For example, upon being properly secured to the swing set 12, the target screen 14 can move no more than 10 inches, more preferably no more than 6 inches, from its neutral position during normal use of the sports training apparatus 10.

In an exemplary embodiment, the top attachment apparatus 60 includes a plurality of bungee cords 64*a*, for example canopy bungee cords. The bungee cords 64*a* are received through grommets 66*a* provided near the top edge of the target screen 14 and tied around a front top rail 68 of the monkey bars 56 thereby attaching the target 14 to the top rail 68 and holding it in upright vertical orientation. The grommets 66*a* provide reinforcement to openings provided in the target screen 14 thereby enlarging the useful life of the target screen 14.

A pair of hooks 70*a*, for example screw eyes, are provided in the top front rail 68 just outside of the upper corners of the screen 14. These hooks 70*a* assist in anchoring the target screen 14 leftward and rightward thereby holding the screen 14, and thus the front major surface 16, in an open deployed position. For each of the upper corners of the target screen 14, the bungee cord 64*a* is routed through the respective grommet 66*a* and hook 70*a* and tied around the front top rail 68. Where an existing hook for holding a swing is located in a suitable position, the swing set hook may be used in place of the hook 70*a*.

The use of bungee cords 64*a* as the top attachment apparatus 60 provides numerous advantages. For example, the target screen 14 can be quickly and simply released from the top rail 68 by simply undoing the bungee cords 64*a*. Additionally, the bungee cords 64*a*, by being elastic will stretch when subjected to sufficient loading and will return to their original shape upon removal of the load, thereby reducing the magnitude of forces seen at the grommets 66*a* when the target screen 14 has been impacted by a ball during normal use or from accidental occurrences such as when a person falls into the target screen 14.

Although a preferred embodiment has been illustrated, it is to be understood that other configurations for the top attachment apparatus are contemplated. Other examples include (not illustrated herein) the target screen 14 being hung by its grommets 66*a* to hooks provided in the top rail 68, the target screen 14 being tied by rope to the top rail 68, or the target screen 14 being nailed to the top rail 68, nevertheless these alternatives are not preferred as they do not afford all of the advantages seen by use of bungee cords 64*a*.

Figure 14:
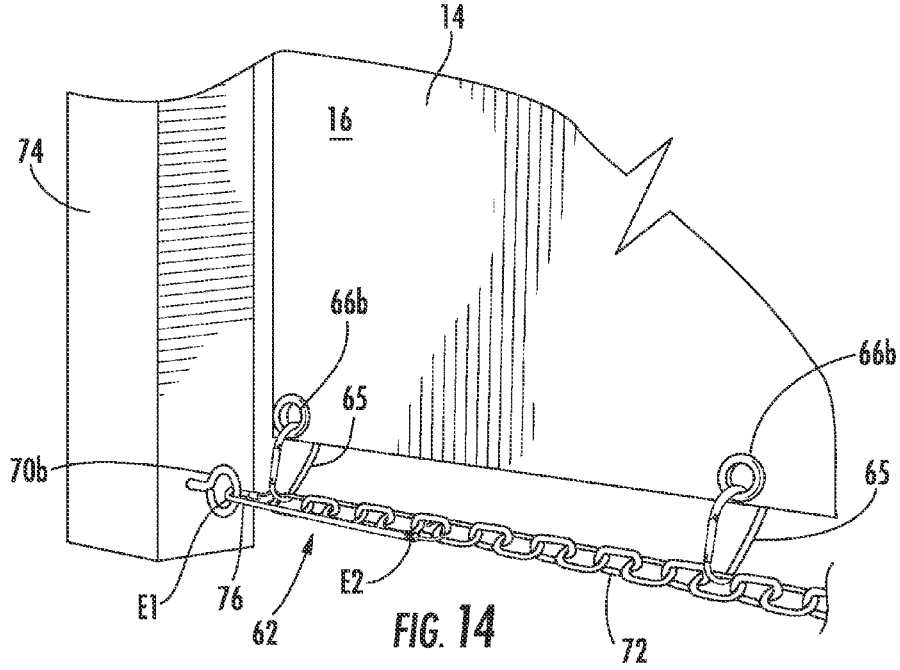
FIG. 14 is a detail taken from FIG. 1, illustrating the method of attachment of the bottom left corner of the sports training apparatus to the swing set.

Referring to FIGS. 1 and 14, the bottom attachment apparatus 62 assists in holding the target screen 14 in the deployed position by providing an anchoring member 72. The anchoring member 72 is attached at or near the bottom of the target screen 14 by, for example, hooks 65, clips, bungee cords, or the like. The anchoring member 72 can be a member which adds mass, preferably at least 3 pounds, more preferably at least 5 pounds, at or near the bottom of the target screen 14.

The anchoring member 72 is attached to the target screen 14 by any suitable means, such as the illustrated hooks 65, which are received through grommets 66*b* provided near the bottom edge of the target screen 14. The grommets 66*b* provide reinforcement to openings provided in the target screen 14 thereby enlarging the useful life of the target screen 14.

In the exemplary embodiment illustrated by FIGS. 1 and 14, the anchoring member 72 is a metal chain position along the bottom of the target screen 14, although it is understood that other objects could be used as an anchor such as a pipe or rod. Nonetheless, a metal chain is preferred due its high density and links which make it simple to attach other items to the chain. The added mass of the anchoring member 72 dissipates energy and dampens movement of the target screen 14 that would otherwise occur upon application of a force, such as that from an impacting baseball. As a result, the magnitude of impact forces borne at the grommets 66*b* are reduced as compared to the target screen 14 without the added mass. Being that the target screen 14 is connected to the anchoring member 72 at a plurality of locations, force loads are distributed among these locations rather than fully impacting a singular connection point. The mass also assists in returning the target screen 14 to its neutral vertical orientation after application of a force thereto.

A pair of hooks 70*b*, for example screw eyes, are provided in the front legs 74 of the ladders 58 outside of the lower corners of the target screen 14. These hooks 70*b* assist in anchoring the target screen 14 leftwards and rightwards thereby holding the screen 14, and thus the front major surface 16, in an open deployed position. For each of the lower corners of the target screen 14, a bungee cord 76 is routed through the respective hook 70*b* wherein one end (E1) of the bungee cord 76 is attached to the anchoring member 72 at a location outwards of the target screen 14 whereas the other end (E2) is attached anywhere along the chain at a distance in which the bungee cord 76 is made to be taunt. In this manner, different distances between the chain 72 and ladder legs 74 can be accommodated by attaching one end (E1) of the bungee cord 76 to the end of the chain 72, routing it through the hook 70*b*, then attaching the other end of the bungee cord (E2) to any position along the chain 72 at which the bungee 76 becomes taunt. The use of bungee cords 76 provides numerous advantages. For example, the target screen 14 can be quickly and simply released from the ladder 58 by undoing the bungee cords 76. Additionally, the bungee cords 76, by being elastic, will stretch when subjected to sufficient loading and will resiliently return to their original shape upon removal of the load, thereby reducing the magnitude of forces seen at the hooks 70*b* and grommets 66*b* when the target screen 14 is impacted by a ball or other object.

The target screen 14 may also include one or more additional apertures through which balls may be thrown. Referring to FIGS. 1-4, 15 and 16, such additional apertures may include an array of defensive targets which are typically associated with playing baseball, for example a second aperture

78 sized and positioned for practicing a cutoff throw, a third aperture 80 sized and positioned for practicing a throw to first base, a fourth aperture 82 sized and positioned for practicing a throw around the horn, and a fifth aperture 84 sized and position for practicing a throw for when a person is stealing second base.

In the preferred embodiment, the second aperture 78 is about 16 inches in diameter and having a center that is about 64 inches from the bottom of the target screen 14 and about 14 inches from the closest side of the target screen 14. The third aperture 80 is located above the strike zone 24 and is about 12 inches in diameter and having a center that is about 58 inches from the bottom of the target screen 14 and centered between the left and right sides of the target screen 14. The fourth aperture 82 is about 9 inches in diameter and having a center that is about 40 inches from the bottom of the target screen 14 and about 16 inches from the closest side of the target screen 14. The fifth aperture 84 is about 6 inches in diameter and having a center that is about 16 inches from the bottom of the target screen 14 and about 12 inches from the closest side of the target screen. It is contemplated that the above identified apertures 78, 80, 82, 84 may be presented in a different locations on the target screen 14, be of different sizes than that discussed above, and that more or less apertures may be provided. It is further contemplated that apertures having a size and location more suitable for receiving a thrown football or kicked soccer ball may be provided in lieu of or in addition to the baseball practice apertures 78, 80, 82, 84. Where the structure allows, the target screen 14 may be made sufficiently large to accommodate the strike zone 24, the baseball practice apertures 78, 80, 82, 84, and also apertures for receiving a football and/or soccer ball.

A rear net 86 is attached to the swing set 12 in order to capture thrown balls which pass through the strike zone 24 and those that pass through the baseball practice apertures 78, 80, 82, 84. Referring to FIG. 1, the net 86 is attached at its top to rear top rail 88 and along its left and right sides to respective rear support legs 90 by a plurality of bungee cords 92, such as canopy bungee cords.

The described top and bottom attachment apparatuses 60, 62 suitably hold the target screen 14 in the deployed position when the structure being attached to is a swing set 12 having monkey bars 56 and side ladders 58. However, where a swing set has only one or no ladders, the bottom attachment apparatus 62 may be attached to another component of the swing set which would still enable the target screen 14 to be deployed in the desired vertical orientation. That is, the swing set may have a component of a slide, picnic bench, or other part to which the anchoring member 72 may ultimately be attached.

Figure 15:
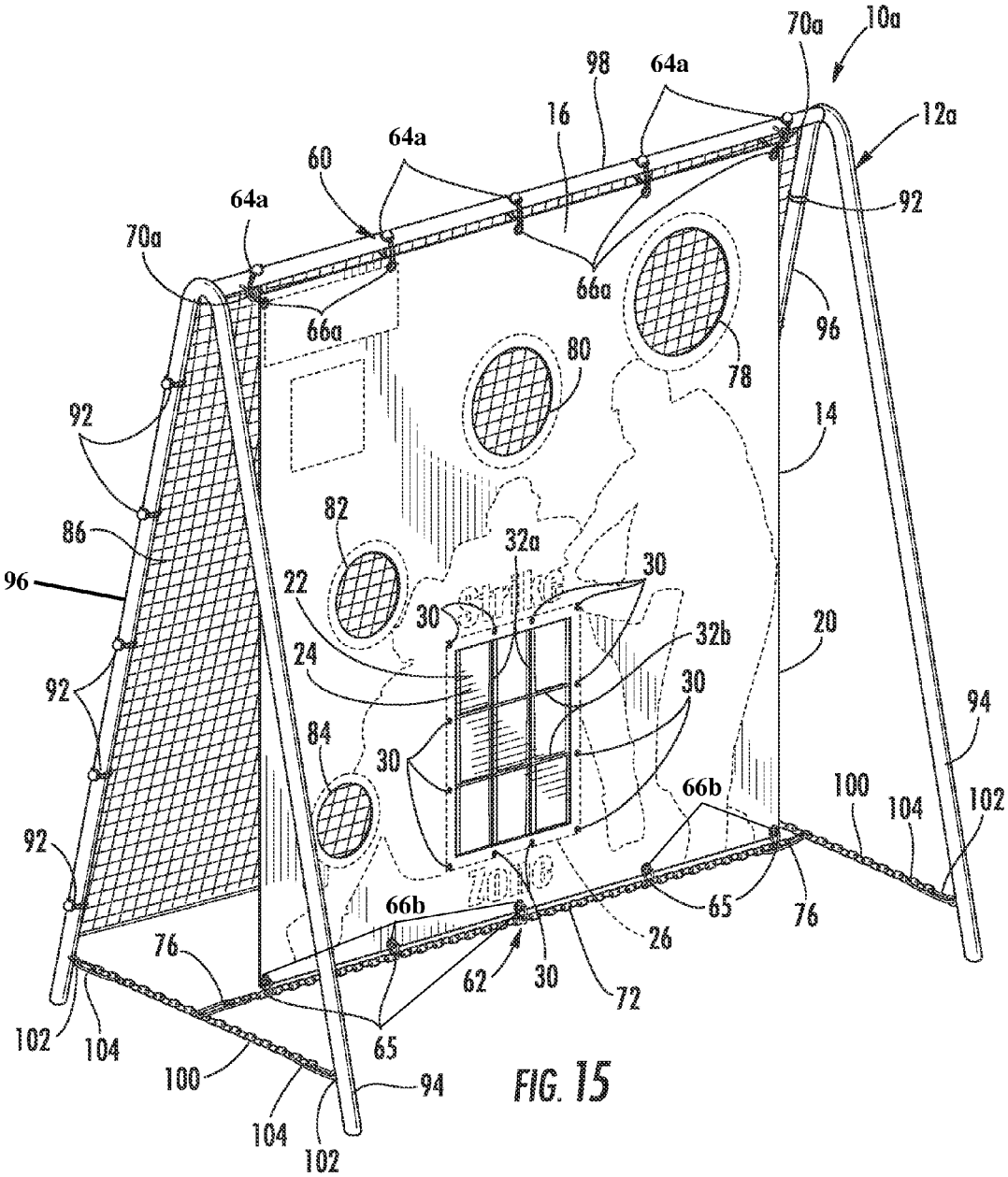
FIG. 15 is a top, front left side perspective view of the sports training apparatus for practicing pitching and aiming a baseball, illustrating a method of attachment to an A-frame type of swing set, in accordance with an embodiment of the present invention.

Referring to FIG. 15, the sports training apparatus 10*a* is as described and illustrated by the embodiment of FIGS. 1-14 and all such description is incorporated herein except as otherwise noted. Same reference numbers used among the various FIGS. herein refer to similar elements and, thus, the written description for that element applies to all embodiments in which that reference number is used, unless otherwise stated. Here, the structure 12*a* does not include swing set components in a desired position for attachment to by the bottom attachment apparatus 62. An example of such a structure is an A-frame swing set 12*a* which has a pair of front and rear support legs 94, 96 joined by a crossbar 98. Here, if the bottom attachment apparatus 62 was attached to the front support legs 94 or rear support legs 96, the target screen 14 would be respectively angled downwards or upwards instead of the desired vertical orientation. Additionally, as there is only one crossbar 98, both the net 86 and target screen 14 may be attached to the crossbar by the same elastic members 64*a*.

In order to provide vertical orientation of the target screen 14, left and right members 100 are spanned between the front and rear legs 94, 96. For example, the members 100 can be chains attached to the front and rear legs 94, 96 by elastic members 104 held by hooks 102 to the legs 94, 96. Thereafter, the bottom attachment apparatus 62 is attached at a midpoint of the members 100 thereby holding the target screen 14 in a deployed vertical position.

Figure 16:
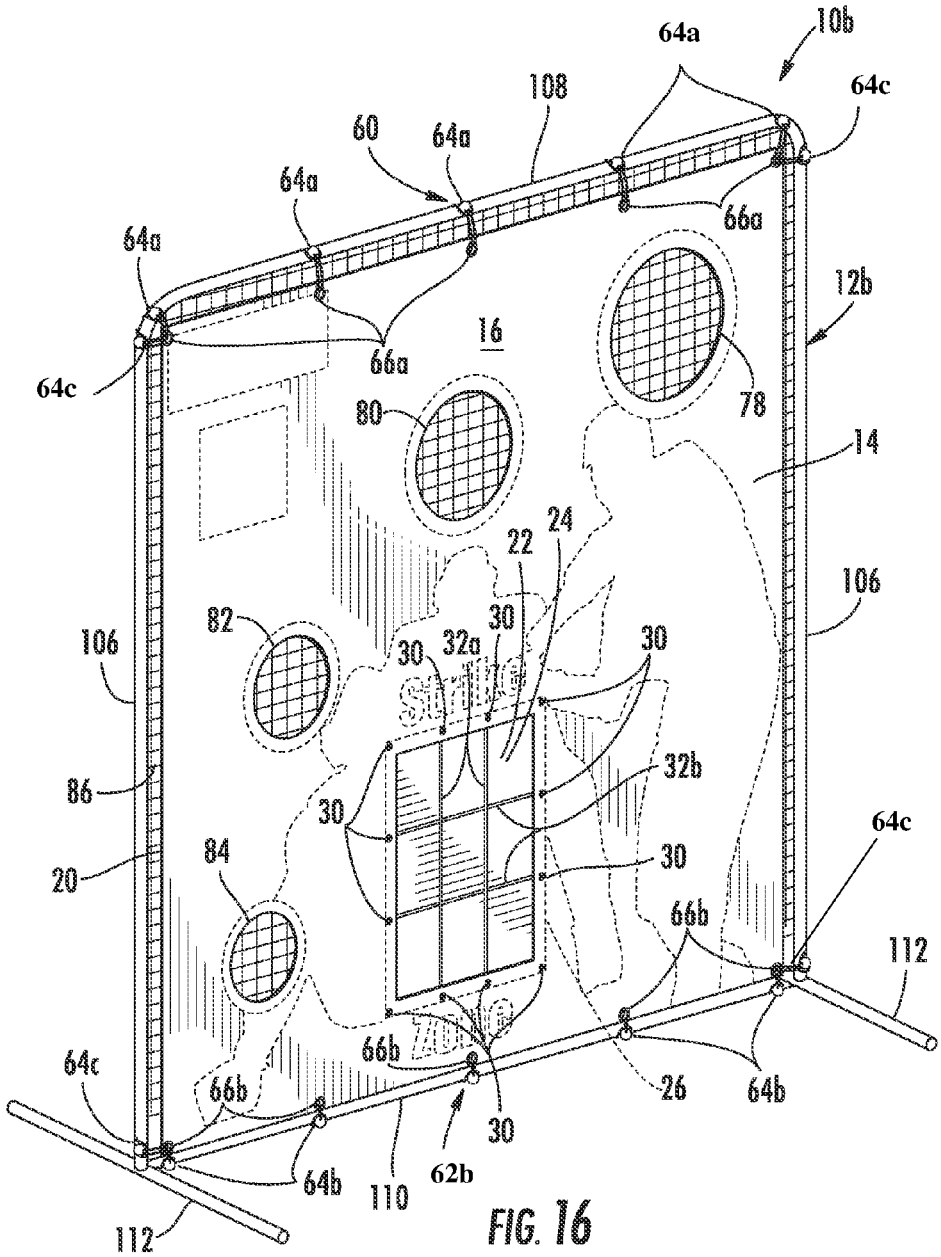
FIG. 16 is a top, front left side perspective view of the sports training apparatus for practicing pitching and aiming a baseball, illustrating a method of attachment to an installation frame configured for application with the sports training apparatus, in accordance with an embodiment of the present invention.

It is noted that although the sports training apparatus 10, 10*a* has been described principally in use with a swing set 12, 12*a*, it may also be attached for use to other structures, for example the dedicated installation frame 12*b* comprising left and right sides, top and bottom members 106, 108, 110 and support feet 112 to maintain the frame 12*b* in an upright position, as illustrated in FIG. 16. Same reference numbers used among the various FIGS. herein refer to similar elements and, thus, the written description for that element applies to all embodiments in which that reference number is used, unless otherwise stated. In this embodiment, the sports training apparatus 10*b* is as described and illustrated by the embodiment of FIGS. 1-14 and all such description is incorporated herein except as otherwise noted. Here the principal difference is that the bottom attachment apparatus 62*b* has a configuration which does not include an anchoring member 72 (see FIG. 1), instead elastic members 64*b*, preferably bungee cords, directly attached the bottom of the target screen 14 to the installation frame 12*b*. Elastic members 64*c* attached the target screen 14 to the left and right sides 106 of the frame 12*b* to restrict leftward and rightward movement of the target screen 14 within the frame 12*b*. Additionally, as there is only one top member 108, both the net 86 and target screen 14 may be attached to the crossbar by the same elastic members 64*a*.

While various embodiments have been described in detail and by way of illustration, it will be understood that various modifications and substitutions may be made in the described embodiments without departing from the spirit and scope of the invention as defined by the appended claims.

That which is claimed is:

1. An apparatus for use in practicing pitching and aiming a baseball, comprising:

a target screen having a first attachment apparatus for attaching said target screen to a structure and a first aperture;

a frame attached to said target screen, wherein said frame is positioned at a perimeter of said first aperture and reinforces said target screen around said perimeter of said first aperture against impacts such as impacts of thrown baseballs;

said frame defining an opening generally having the shape and size of a baseball strike zone;

said first aperture and said opening communicate whereby a thrown baseball which passes through said first aperture also passes through said opening;

said frame having a rigid construction;

one or more elastic member attached to said frame, wherein said one or more elastic member divides said opening into two or more sections whereby said one or more elastic member is characterized by being able to stretch when struck by a baseball and resiliently return to its original shape after removal of force from the baseball; and at least one mechanical fastener which releaseably attaches said one or more elastic member to said frame and said frame to said target screen such that said one or more elastic member and said frame can be removed from said target screen and replaced without damage to said target screen.

2. The apparatus in accordance with claim 1 wherein said opening defined by said frame is generally rectangular having a height in a range of about 20 inches 26 inches and a width in a range of about 16 inches to 22 inches.

3. The apparatus in accordance with claim 1 further comprising two elastic members attached to said frame and being generally horizontally disposed across said opening and two elastic members attached to said frame and being generally vertically disposed across said opening when said target screen is in a deployed position, wherein said horizontally and vertically disposed elastic members divide said opening into nine sections, and whereby said horizontally and vertically disposed elastic members are characterized by being able to stretch when struck by the baseball and resiliently return to their original shape after removal of force from the baseball.

4. The apparatus in accordance with claim 3 wherein said elastic members divide said opening into nine generally rectangular sections arranged in a pattern of three rows and three columns wherein each section has a height in a range of about 6⅔ inches to 8⅔ inches and a width in a range of about 5½ inches to 7⅓ inches.

5. The apparatus in accordance with claim 4 further including flaps attached to said elastic members, wherein said flaps hang in each of said sections to provide a visual confirmation of strike location of a ball thrown through said opening.

6. The apparatus in accordance with claim 3 wherein said two horizontally disposed elastic members and said two vertically disposed elastic members cross over each other, wherein said horizontally disposed elastic members are attached to said vertically disposed elastic members at locations where they cross over each other.

7. The apparatus in accordance with claim 3 wherein said first attachment apparatus is provided at or near the top of said target screen and being able to hold said target screen in the deployed position when attached to the structure.

8. The apparatus in accordance with claim 7 further comprising a second attachment apparatus wherein said second attachment apparatus is provided at or near the bottom of the target screen and being able to assists in holding said target screen in the deployed position when said target screen is attached to the structure.

9. The apparatus in accordance with claim 8 wherein said second attachment apparatus includes an anchoring member having a mass of 3 pounds or more.

10. The apparatus in accordance with claim 9 wherein said anchoring member is positioned below said target screen when said target screen is in the deployed position.

11. The apparatus in accordance with claim 10 wherein said anchoring member hangs from near or at the bottom of said target screen.

12. The apparatus in accordance with claim 7 wherein said first attachment apparatus further includes top elastic members for attaching said target screen to the structure, wherein said top elastic members can elastically deform upon application of a force upon said target screen and resiliently return their original shape upon removal of the force.

13. The apparatus in accordance with claim 8 wherein said second attachment apparatus further includes bottom elastic members for attaching said second attachment apparatus to the structure, wherein said bottom elastic members can elastically deform upon application of a force upon said target screen and resiliently return to their original shape upon removal of the force.

14. The apparatus in accordance with claim 8 wherein said target screen includes a plurality of grommets near the top and bottom of said target screen and said first attachment apparatus is releaseably attached to said grommets near the top of said target screen and said second attachment apparatus is releaseably attached to said grommets near the bottom of said target screen.

15. The apparatus in accordance with claim 7 wherein said target screen further includes a plurality of apertures positioned in an array pattern across said target screen and each being of sufficient size through which a baseball may pass, wherein said plurality of apertures includes a second aperture positioned above and leftward or rightward of said strike zone, a third aperture positioned above said strike zone and a height less than that of said second aperture, and a fourth aperture positioned at a height lower than said second and third apertures and on an opposed side of said strike zone as is said second aperture, when said target screen is in the deployed position.

16. The apparatus in accordance with claim 15 wherein said target screen further includes graphics depicting at least one athlete in an action pose, numbers which represent point values for said different sections of said opening and said second, third and fourth apertures.

17. An apparatus for use in practicing pitching and aiming a baseball, comprising:

a target screen having a first aperture;

a means for attaching a top of said target screen to a structure and capable of holding said target screen in a deployed position;

a means for attaching a bottom of said target screen to the structure;

a frame attached to said target screen, wherein said frame is positioned at a perimeter of said first aperture and reinforces said target screen around said perimeter of said first aperture whereby structural integrity of said target screen at the perimeter of said first aperture is enhanced against impacts, such as impacts from thrown baseballs;

said frame defining an opening generally having the shape and size of a baseball strike zone;

said first aperture and said opening communicate whereby a thrown baseball which passes through said first aperture also passes through said opening;

said frame having a rigid construction;

one or more elastic member attached to said frame, wherein said one or more elastic member divides said opening into two or more sections whereby said one or more elastic member is characterized by being able to stretch when struck by a baseball and resiliently return to its original shape after removal of force from the baseball; and at least one mechanical fastener which releaseably attaches said one or more elastic member to said frame and said frame to said target screen such that said one or more elastic member and said frame can be removed from said target screen and replaced without damage to said target screen.

18. The apparatus in accordance with claim 17 wherein said means for attaching a top of said target screen includes elastic members which can elastically deform upon application of a force applied to said target screen and resiliently return their original shape upon removal of the force and wherein said means for attaching a bottom of said target screen includes an anchoring member having a mass of 3 pounds or more.

* * * * *